US006621200B2

(12) United States Patent
Reed

(10) Patent No.: US 6,621,200 B2
(45) Date of Patent: Sep. 16, 2003

(54) MICROPHONICS DAMPER CLIP

(75) Inventor: Joseph Arthur Reed, York, PA (US)

(73) Assignee: Thomson Licensing, S.A., Boulogne-Billancourt (FR)

( * ) Notice: Subject to any disclaimer, the term of this patent is extended or adjusted under 35 U.S.C. 154(b) by 170 days.

(21) Appl. No.: 09/782,994

(22) Filed: Feb. 14, 2001

(65) Prior Publication Data

US 2002/0109449 A1 Aug. 15, 2002

(51) Int. Cl.[7] ..... H01J 29/80
(52) U.S. Cl. ..... 313/402; 313/407; 313/408
(58) Field of Search ..... 313/402, 403, 313/404, 405, 407

(56) References Cited

U.S. PATENT DOCUMENTS

2001/0002352 A1 * 5/2001 Mizuta et al. ..... 445/35

* cited by examiner

*Primary Examiner*—Sandra O'Shea
*Assistant Examiner*—Guiyoung Lee
(74) *Attorney, Agent, or Firm*—Joseph S. Tripoli; Carlos M. Herrerra; Reitseng Lin

(57) ABSTRACT

A microphonic damper clip for mounting to the border of a tension mask. The damper clip is formed of two halves with each half having a first leg and an integral second leg. The free end of one of the legs from each of the two halves of the damper clip are inserted into an aperture disposed on the border of the tension mask. At least one free end of each corresponding leg is then attached to one another to form a damper clip.

2 Claims, 3 Drawing Sheets

MICROPHONICS DAMPER CLIP

This invention generally relates to cathode ray tubes and, more particularly, to a microphonic damper clip for a tension mask in a cathode ray tube (CRT).

BACKGROUND OF THE INVENTION

A color picture tube includes an electron gun for forming and directing three electron beams to a screen of the tube. The screen is located on the inner surface of the faceplate panel of the tube and comprises an array of elements of three different color emitting phosphors. An aperture mask, which may be either passive, i.e., a shadow mask or active, i.e., a focus mask, is interposed between the gun and the screen to permit each electron beam to strike only the phosphor elements associated with that beam. The aperture mask is a thin sheet of metal, such as steel, that is contoured to somewhat parallel the inner surface of the tube faceplate. An aperture mask may be either formed or tensioned.

A tension mask is stretched over a strong, specially shaped frame to form a sector of a cylindrical surface or may alternatively be shaped to form a substantially flat mask. The tension ensures that the apertures formed on the mask remain in alignment with the phosphor elements on the screen. This design has a disadvantage that the mask is subject to vibration from external sources (e.g., speakers near the tube) otherwise known as microphonics. Such vibration varies the positioning of the apertures through which the electron beam passes, resulting in visible display fluctuations. Ideally, these vibrations need to be eliminated or, at least, mitigated to produce a commercially viable television picture tube.

SUMMARY OF THE INVENTION

The present invention provides vibration damper clips attached to a border of a tension mask. The vibration damper clips are formed of two halves with each half having a first and second leg. The first leg from each half is inserted into a respective aperture disposed on the border of the tension mask. Each half is rotated, where each first leg abuts each other. The first legs are then attached to one another. When joined, both halves form a damper clip for damping the vibrations subjected to the tension mask.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 1:
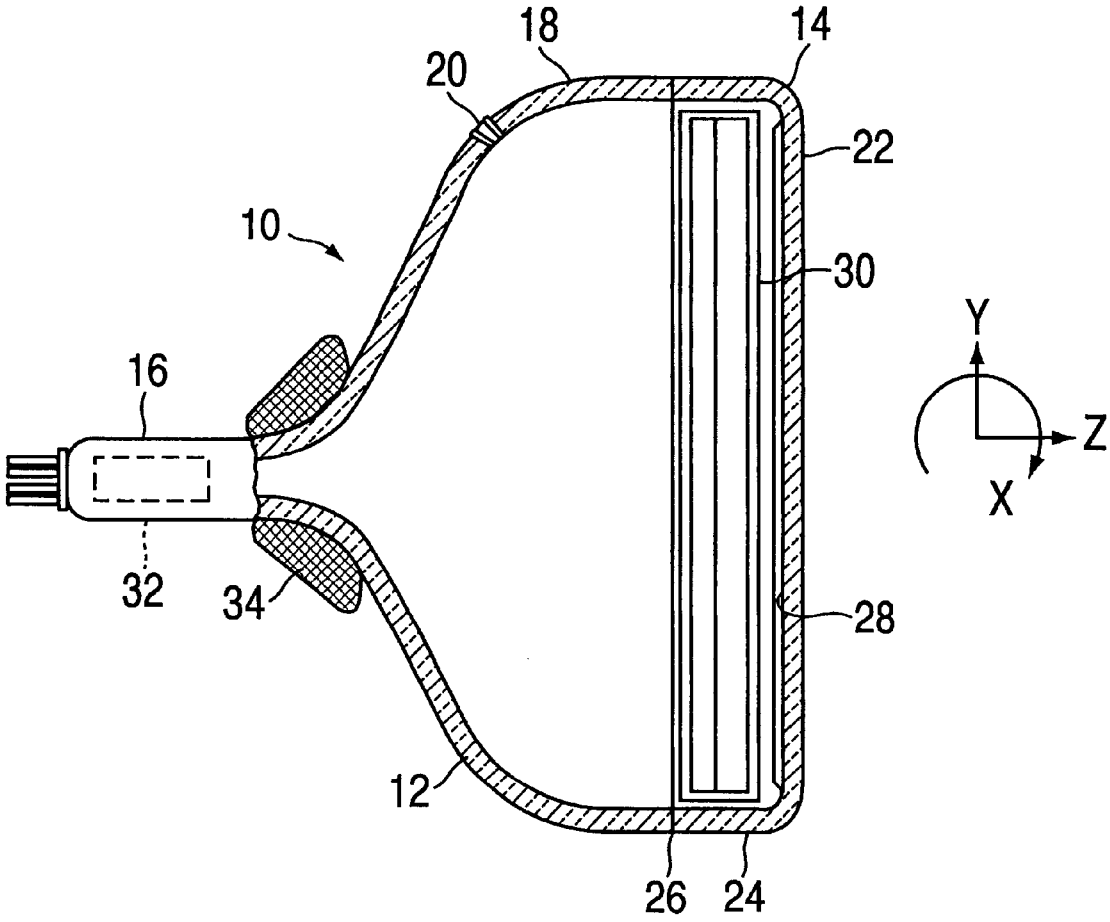
FIG. 1 is a side view, partly in axial section, of a color picture tube, including a tension mask-frame-assembly according to the present invention.

FIG. 1 shows a CRT 10 having a glass envelope 12 comprising a rectangular faceplate panel 14 and a tubular neck 16 connected by a rectangular funnel 18. The funnel 18 has an internal conductive coating (not shown) that extends from an anode button 20 to the neck 16. The panel 14 comprises a viewing surface 22 and a peripheral flange or sidewall 24 that is sealed to the funnel 18 by a glass frit 26. A three-color phosphor screen 28 is carried by the inner surface of the faceplate panel 14. The screen 28 is a line screen with the phosphor lines arranged in triads, each triad including a phosphor line of each of the three primary colors. A tension mask 30 is removably mounted in a predetermined spaced relation to the screen 28. The mask may be either a tension focus mask or a tension mask. An electron gun 32 (schematically shown by the dashed lines in FIG. 1) is centrally mounted within the neck 16 to generate three in-line electron beams, a center beam and two side beams, along convergent paths through the mask 30 to the screen 28.

The CRT 10 is designed to be used with an external magnetic deflection yoke, such as the yoke 34 shown in the neighborhood of the funnel to neck junction. When activated, the yoke 34 subjects the three beams to magnetic fields that cause the beams to scan horizontally and vertically in a rectangular raster over the screen 28.

Figure 2A:
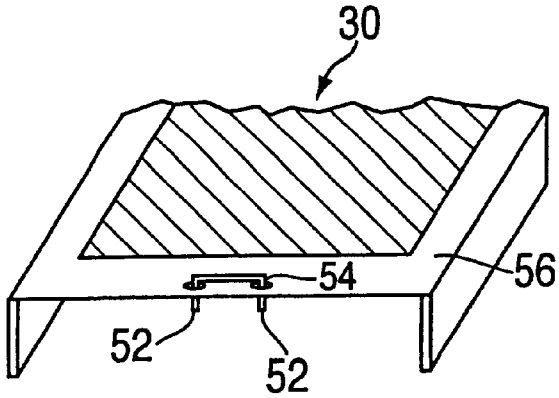
FIG. 2A PRIOR ART
FIGS. 2A and 2B together depict a prior art damper clip.
Figure 2B:
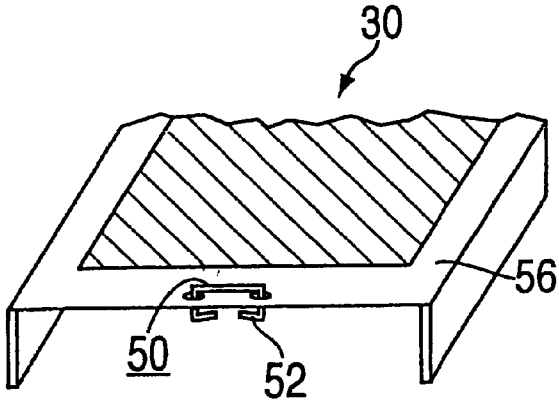
FIG. 2B PRIOR ART
Figure 4A:
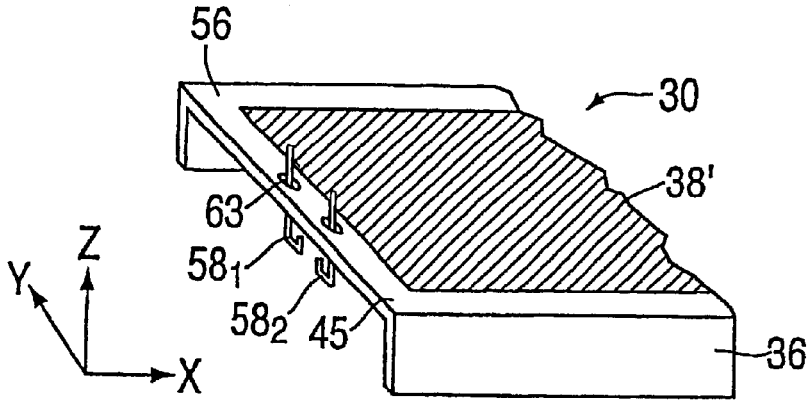
FIGS. 4A, 4B and 4C together depict each half of the damper clip being inserted into a border of the tension mask.

The tension mask 30, a section of which is shown in FIGS. 4A, B, and C, is interconnected and held in tension to a frame 36. The long sides of the tension mask 30 parallel a central major axis, X, of the CRT 10; and the short sides parallel a central minor axis, Y, of the CRT 10. The major and minor axis are along the plane of the tension mask 30 in the case of a substantially flat mask as shown. The tension mask 30 includes an aperture portion 38 illustrated generally as cross-hatches. The tension mask 30 has a border 56. A damper clip 58 is attached to the border 56 to mitigate vibration in the tension mask 30 as will be described in greater detail below. FIGS. 2A and 2B together depict a prior art damper clip 50. Specifically, damper clip 50 comprises a pair of legs 52 joined to a center member 54 to form a U-shape. Damper clip 50 is "stapled" into a border 56 of the tension mask 30 such that the pair of legs 52 are compressed and bent toward each other without touching (See FIG. 2B). The stapling of damper clip 50 to the border 56 of the tension mask 30 can damage the tension mask 30 by denting the flexible border 56 of tension mask 30 and thereby scrapping the mask. Also if damper clip 50 is not properly formed, vibrational energy on the mask 30 cannot be adequately damped. Finally, the stapling process can cause the plating of damper clip 50 to flake resulting in blocked apertures on the mask 30 and/or degraded performance of damper clip 50.

Figure 3:
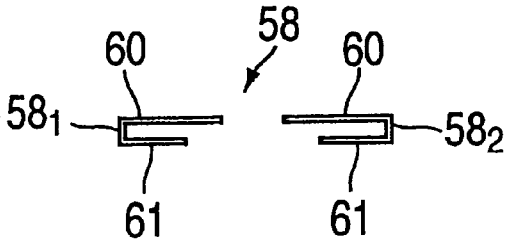
FIG. 3 depicts the damper clip according to the present invention.

FIG. 3 depicts the damper clip 58 according to the present invention. Specifically, FIG. 3 depicts each half of the damper clip comprising a first half $\mathbf{58}_1$ and a second half $\mathbf{58}_2$ (collectively damper clip 58).

Each half of the damper clip 58 has a first L-shaped legs 60. The second leg 61 of both halves of the damper clip 58 lies generally parallel to the surface of the tension mask 30 and in close proximity to the first leg 60 and is preferably shorter than the first leg 60. The spacing between the first leg 60 is preferably about 100 mils from the second leg 61 and together form a generally U-shaped body. However, the length and shape of the legs 60 and 61 may be of various size and configuration with at least one leg from each half $\mathbf{58}_1$ and $\mathbf{58}_2$ being constructed so as to permit mating of both halves of the damper clip 58 when mounted within the border 56 of the tension mask 30.

Figure 4B:
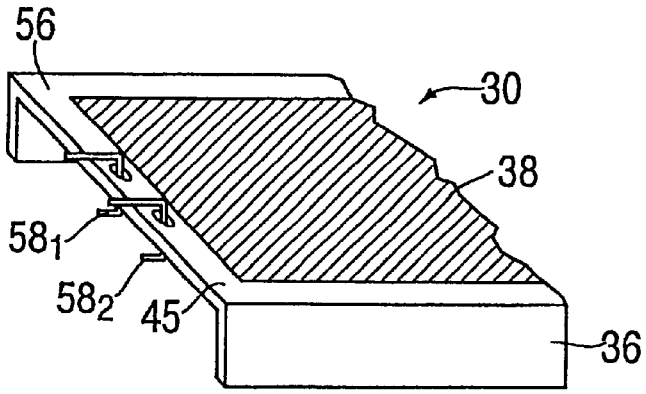
Figure 4C:
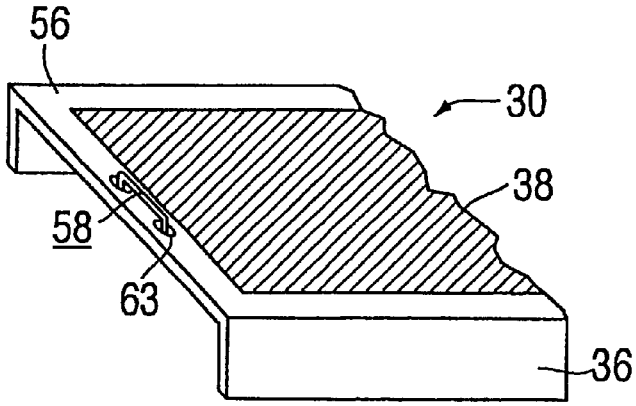

FIGS. 4A, 4B and 4C together depict the damper clip 58 being inserted into a border 56 of the tension mask 30.

Specifically, a plurality of apertures 63 having a diameter of about 80 mils are preformed on the border 56 of the tension mask 30. The first leg 60 of each half of the damper clip 58 are inserted through an aperture 63 (See FIG. 4A).

The first and second half $\mathbf{58}_1$ and $\mathbf{58}_2$ are turned 90 degrees so that the first legs 60 of the first and second half $\mathbf{58}_1$ and $\mathbf{58}_2$ are substantially inserted through the aperture 63 (See FIG. 4B). The first legs 60 of the first and second half $\mathbf{58}_1$ and $\mathbf{58}_2$ are then aligned with one another and connected by welding, splicing, crimping, gluing or the like (See FIG. 4C) thereby mating the first and second half $\mathbf{58}_1$ and $\mathbf{58}_2$ and forming the damper clip 58. While only the first legs 60 are shown attached, both legs may be attached after each half $\mathbf{58}_1$ and $\mathbf{58}_2$ are mounted to the border 56. Also, while one damper clip is shown, additional clips may be used to adequately damp the vibration of the mask.

The embodiments of FIGS. 4A–4C relate to cut-out and bent metallic alloy parts such as steel or aluminum which can be pre-plated with any of the standard plating materials if desired. The legs 60 and 61 are folded so that the free ends are directed toward the same direction. The present invention, however, may be subject to many modifications and changes such as folding the legs 60 and 61 in opposite directions without departing from the spirit or essential characteristics thereof. Additionally, the damper clip 58 may be mass produced with a conventional formed cast thereby eliminating the need for bending the material in the shapes described above.

As the embodiments that incorporate the teachings of the present invention have been shown and described in detail, those skilled in the art can readily devise many other varied embodiments that still incorporate these teachings without departing from the spirit of the invention.

What is claimed is:

1. A process for forming a microphonic damper clip for a CRT mask, said mask having a border with apertures therethrough and said damper clip having a separate first half and second half, each of said halves having a first and second free leg, the process comprising:

inserting said first free leg of said first half through one of said apertures;

inserting said first free leg of said second half through another of said apertures;

rotating said first free leg of said first and second half toward one another; and connecting said first free leg of said first and second half whereby said first and second half form a damper clip.

2. A process for forming a microphonic damper clip as in claim 1, further comprising connecting said second free leg of said first and second half.

* * * * *